US012480731B2

(12) United States Patent
Bratich

(10) Patent No.: US 12,480,731 B2
(45) Date of Patent: Nov. 25, 2025

(54) GUN FOREARM SUPPORT APPARATUS

(71) Applicant: Eli Bratich, Pittsburgh, PA (US)

(72) Inventor: Eli Bratich, Pittsburgh, PA (US)

( * ) Notice: Subject to any disclaimer, the term of this patent is extended or adjusted under 35 U.S.C. 154(b) by 0 days.

(21) Appl. No.: 18/387,032

(22) Filed: Nov. 4, 2023

(65) Prior Publication Data

US 2024/0159489 A1 May 16, 2024

Related U.S. Application Data

(60) Provisional application No. 63/425,335, filed on Nov. 15, 2022.

(51) Int. Cl.
*F41A 23/16* (2006.01)

(52) U.S. Cl.
CPC ..... *F41A 23/16* (2013.01)

(58) Field of Classification Search
CPC ..... F41A 23/16; F41A 23/06
See application file for complete search history.

(56) References Cited

U.S. PATENT DOCUMENTS 1,890,423 A * 12/1932 Teagarden ..... F41A 23/00 248/354.6
2,774,563 A * 12/1956 Pribis ..... F41A 23/16 217/57
2,877,689 A * 3/1959 Pribis ..... F41A 23/00 73/167
3,225,656 A * 12/1965 Flaherty ..... F41A 23/06 89/37.04
4,449,314 A * 5/1984 Sorensen ..... F41A 23/00 221/64
4,548,392 A * 10/1985 Rickling ..... F41A 23/00 269/275
4,558,531 A * 12/1985 Kilby ..... F41A 23/00 42/94
4,558,532 A * 12/1985 Wright ..... F41A 23/00 42/94
4,575,964 A * 3/1986 Griffin ..... F16M 11/28 42/94
4,594,805 A * 6/1986 McClelland ..... A01K 97/10 248/528
4,790,096 A * 12/1988 Gibson ..... F41A 23/16 42/94
5,414,949 A * 5/1995 Peebles ..... F41A 23/16 89/37.04
D375,538 S * 11/1996 Minneman ..... D22/199
5,600,913 A * 2/1997 Minneman ..... F41A 23/06 248/125.3
D382,035 S * 8/1997 Swicegood ..... D22/199
5,661,919 A * 9/1997 Pryor ..... F41A 23/16 89/37.04
D387,123 S * 12/1997 Hughes ..... D22/199
5,738,256 A * 4/1998 Goff ..... A45F 5/00 224/908

(Continued)

*Primary Examiner* — Joshua E Freeman
(74) *Attorney, Agent, or Firm* — York Law LLC; Olen L. York, III

(57) ABSTRACT

A gun forearm support apparatus includes a base, an adjustable upright, and a saddle. The upright comprises two opposing ends, wherein the first end is coupled to the base via an articulating hinge (or hinges), wherein the second end supports the saddle. Upon deployment, the forearm support vertically supports a gun forearm within the saddle as supported by the upright depending from the base.

15 Claims, 3 Drawing Sheets

(56) References Cited

U.S. PATENT DOCUMENTS

D406,629 S * 3/1999 Banfill ..... D22/100
5,930,931 A * 8/1999 Watson ..... F41A 23/04 206/317
5,988,466 A * 11/1999 Brown ..... F41C 33/001 224/660
6,042,080 A * 3/2000 Shepherd ..... B60R 11/00 248/688
6,192,613 B1 * 2/2001 Lantz ..... F41A 23/16 89/37.04
6,196,513 B1 * 3/2001 Edwards ..... A01K 97/10 248/528
6,253,482 B1 * 7/2001 Peterson ..... F41A 23/16 42/94
6,305,117 B1 * 10/2001 Hales, Sr. ..... F41A 23/16 89/37.04
6,793,108 B2 * 9/2004 Williams, Jr. ..... B60R 7/14 224/558
8,307,576 B1 * 11/2012 Bogart ..... F41A 23/16 248/176.1
8,683,730 B1 * 4/2014 Moore ..... F41A 23/16 42/94
8,763,297 B2 * 7/2014 Boll ..... F41A 23/04 42/94
8,931,193 B1 * 1/2015 Bogart ..... F41A 23/16 42/1.06
9,140,512 B2 * 9/2015 Witchel ..... F41A 25/00
9,625,229 B1 * 4/2017 Hilz ..... F41A 23/02
10,782,085 B2 * 9/2020 Cauley, Jr. ..... F41A 23/12
11,415,384 B1 * 8/2022 Dvorak ..... F41A 23/16
12,135,181 B1 * 11/2024 Hunger ..... F41A 23/02
2009/0025267 A1 * 1/2009 Reinert ..... F41C 27/00 42/94
2010/0236125 A1 * 9/2010 Morrow ..... F41A 23/02 42/94
2013/0086835 A1 * 4/2013 Minneman ..... F41A 23/16 42/94
2020/0208933 A1 * 7/2020 Wynalda, Jr. ..... F41A 23/06
2020/0263948 A1 * 8/2020 Cauley, Jr. ..... F41A 23/16
2021/0293504 A1 * 9/2021 Wynalda, Jr. ..... F41A 23/16

* cited by examiner

GUN FOREARM SUPPORT APPARATUS

I. RELATED APPLICATIONS

This application claims the benefit of U.S. Provisional Application No. 63/425,335, filed on Nov. 15, 2022.

II. FIELD OF THE INVENTION

The present application discloses and describes a gun forearm support apparatus, and more particularly, a gun forearm support apparatus.

III. BACKGROUND OF THE INVENTION

A variety of means have been used to support a gun during firing. Among the means used, including gloved-hands, horizontal shelves/benches, compressible bags, and/or bi-pods/tri-pods. Notably, gloved-hands and shelves/benches do not provide much stability. Pre-shot, hands or shelves/benches prevent proper sighting of the target down-range. Because of the instability, it is virtually impossible to sight the target with the precision that many target shooting enthusiasts' desire. Post-shot, during firing of the gun, hands and shelves/benches tend to encourage concussive-movement of the gun post-firing. This type of free post-shot movement might result in injury to the user or others around the user.

Stability devices have been offered, including U.S. Publication No. 20200348101 (published in the name of Preston), describing a gun stability plate assembly with a widened body that attaches to the fore-end of a stock or chassis of a gun by means of a clamping device. The assembly includes a main body, a clamp assembly, and a track. The clamp assembly is in communication with the main body and is configured to translate adjacent an upper surface of the main body.

Similarly, firearm shooting rests have also been conceived, including U.S. Pat. No. 10,514,225 (issued to Cauley, Jr. et al.), wherein the shooting rest includes a forward support and a rear support both supported by a frame, otherwise known as a sled. The forward support is configured to clamp a forward portion of the firearm and permit rotation of the firearm with respect to the frame about a pitch axis to adjust a vertical aim of the firearm and about a yaw axis to adjust a horizontal aim of the firearm. The rear support includes a platform positioned to support a bottom of a trigger hand grip portion of the firearm.

A rifle rest structure is disclosed in U.S. Pat. No. 8,683,730 (issued to Moore) and is adapted to receive first and second sand bags and operative to place a rifle thereon for target practice or the like. The rifle rest has a unitary frame construction including a front portion that supports the front of a rifle, a rear portion that supports the rear of the rifle, and a middle portion that rigidly interconnects the front and rear portions.

A firearm support attaches to a lower surface of a firearm and helps steady the firearm during shooting from almost any firing position as disclosed in U.S. Pat. No. 10,190,840 (issued to Renteria). The support has a body member that has a firearm lower railing receiving channel on its upper surface and a downwardly and forwardly curving claw extending from the lower surface at the front. The claw has a rounded edge and a centrally disposed wedge opening. The lower surface of the body member is also curved as is the rear surface.

Although compressible bags provide some stability relative to the aforementioned alternatives, such bags have limited utility because of the weighting, sizing, and/or dimensioning that is required. For particular vertical elevations, a user might need multiple compressible bags to properly position the gun. However, the compressibility of the bags still imparts a certain level of instability.

Bi-pod/tri-pod systems provide the most stability and safety of the alternatives presently available. However, most of these systems require additional adjustments to the equipment that necessitates physical connection to the gun itself. This additional expense, effort, and set-up time detract from the experience.

Accordingly, there is a need for an apparatus, system, and/or method that provides a new gun forearm support.

IV. SUMMARY OF THE INVENTION

This disclosure describes various embodiments that relate to ways in which a saddle device can be configured for optimal use as a gun forearm support.

A gun forearm support apparatus is described and includes at least a base, an adjustable upright depending from the base, and a saddle depending from the upright.

A gun forearm support apparatus is described and includes at least a base, an adjustable upright depending from the base, wherein the upright is vertically adjustable and angularly adjustable, and, a saddle depending from the vertical terminus of the adjustable upright, the saddle comprising a first pommel and a second pommel with a vertically recessed seat disposed between the pommels, wherein the seat receives and supports the gun forearm and with the pommels providing lateral bumpers to reduce the lateral movement of the gun forearm.

A gun forearm support apparatus is described and includes at least a base, an adjustable upright assembly comprising a first upright depending from the base via articulation means and a second upright depending from the first upright, wherein the first upright comprises an interior space having larger dimensions than the second upright adapted to promote telescoping movement of the second upright relative to the first upright, wherein the first upright comprises at least one indexing aperture and the second upright comprising a plurality of indexing apertures disposed in a vertical column along a vertical axis coextensive to the at least one indexing aperture formed on the first upright, the articulation means providing angular movement and positioning of the adjustable upright, and, a saddle depending from the vertical terminus of the adjustable upright, the saddle adapted to received and support the forearm of a gun.

Each embodiment of the gun forearm support apparatus may include ballast in the base. It is envisioned that the ballast may comprise one or more removable weights.

Each embodiment of the gun forearm support apparatus may include a port in the base providing access to the internal space formed within the base. It is envisioned that the port provides ingress and egress of the internal space for adding or removing solid and/or fluid material as ballast for the base and the apparatus.

Each embodiment of the gun forearm support apparatus may include an upright that is positionable through 180 degrees of articulation.

The utilization of the gun forearm support apparatus allows a user to place the apparatus on a surface, whether it is the ground, an article placed on the ground, on an elevated surface, or other similar structures, with the forearm of the gun or firearm placed within the saddle. The base provides stability to the apparatus, and assists in supporting the saddle in its positioning via the upright. The upright and saddle height positioning may be adjustable between a minimum and maximum height, with the first upright and its indexing aperture aligned with the appropriately positioned indexing aperture from the second upright to set the desired height.

V. BRIEF DESCRIPTION OF THE DRAWING(S)

The advantages and features of the present invention will become better understood with reference to the following more detailed description and claims taken in conjunction with the accompanying drawings, in which like elements are identified with like symbols, and in which:

Figure 7A:
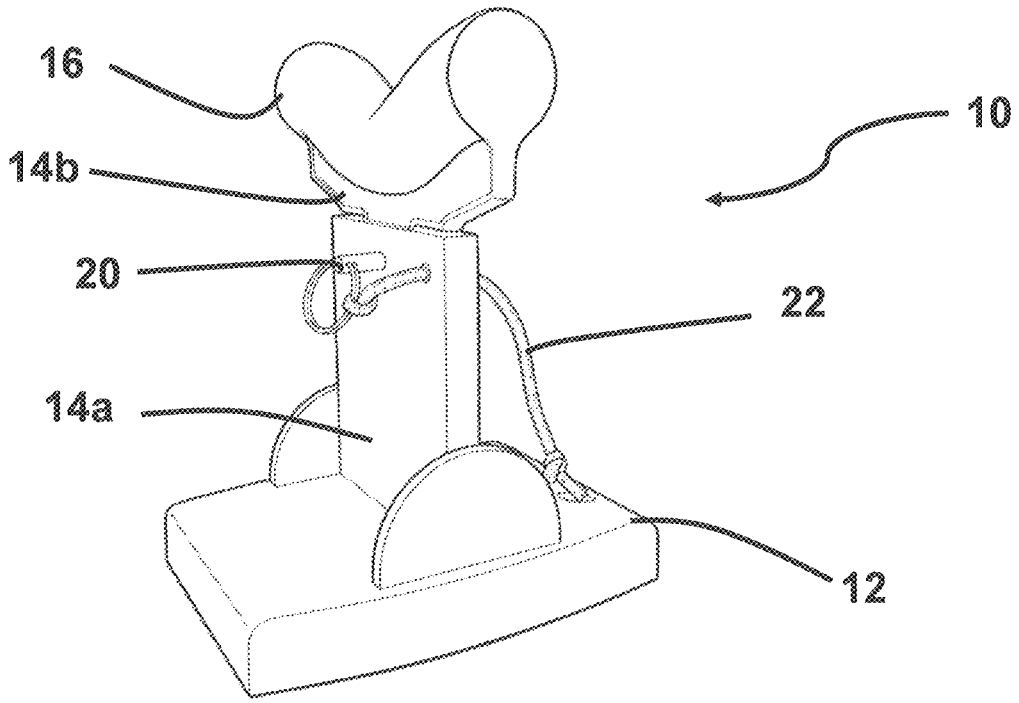
Figure 7B:
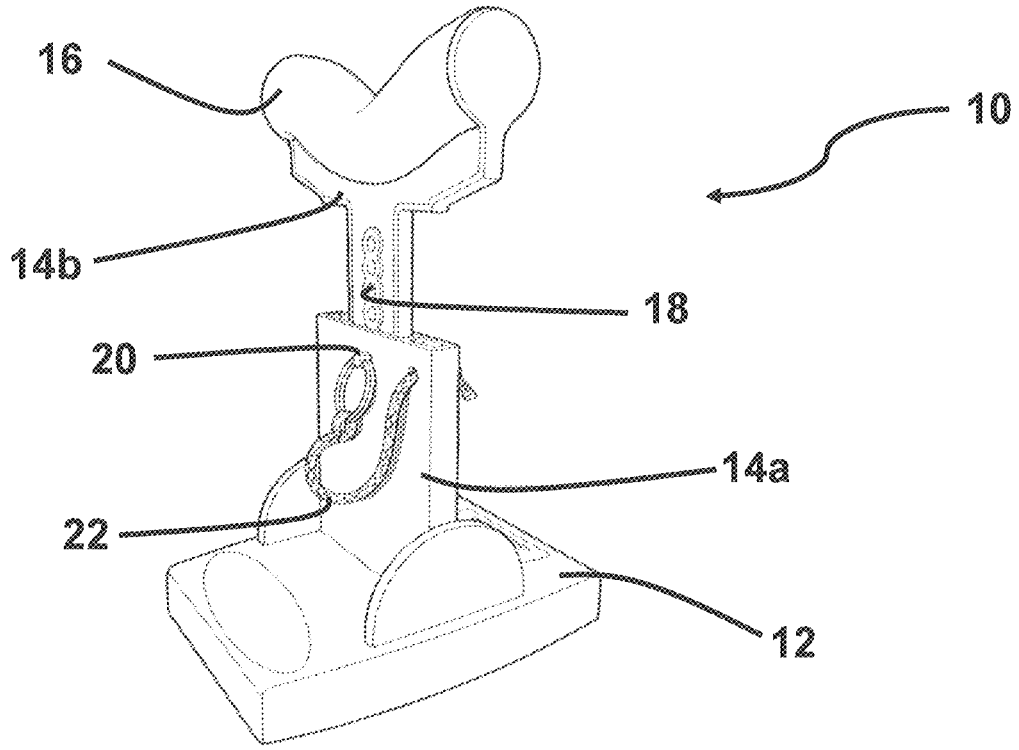

FIG. 7*a* is a perspective view of the apparatus and illustrating the physical orientation of the first upright and second upright using an impinging article or tool; and, FIG. 7*b* is a perspective view of the apparatus and illustrating the physical orientation of the first upright and the second upright wherein the second upright is raised relative to FIG. 7*a* and secured using an impinging article or tool.

VI. DETAILED DESCRIPTION OF THE EMBODIMENT(S)

It will be readily understood that the components of the present invention, as generally described and illustrated in the figures herein, may be arranged and designed in a wide variety of different configurations. Thus, the following detailed description of the embodiments, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Figure 1:
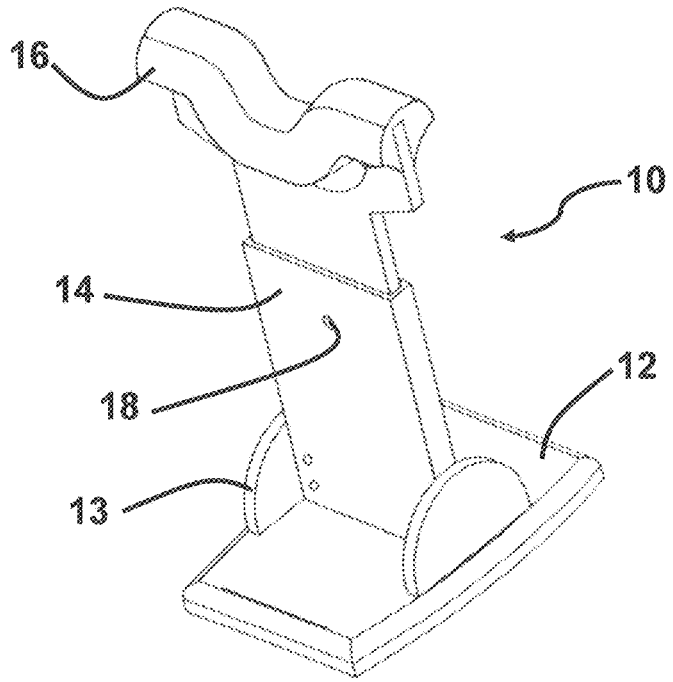
FIG. 1 is a perspective view of the gun forearm support apparatus.
Figure 2:
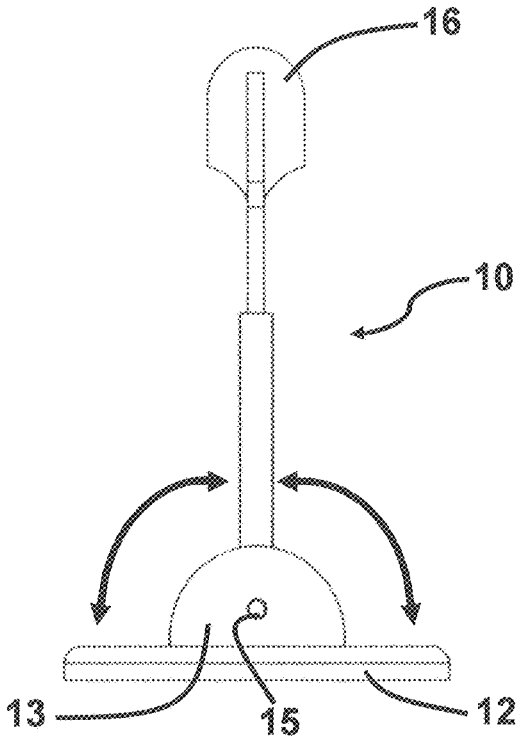
FIG. 2 is a side view of FIG. 1.
Figure 3:
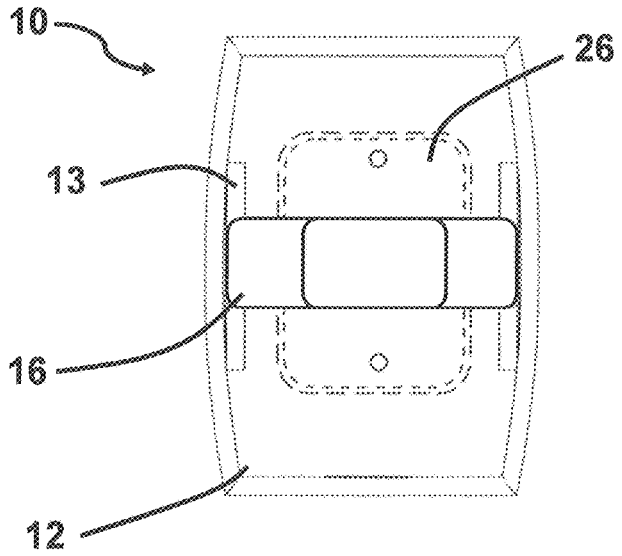
FIG. 3 is a top view of FIG. 1 and FIG. 2.

According to at least one embodiment, and consistent with FIG. 1, FIG. 2, and FIG. 3, a gun forearm support apparatus (generally denoted by reference character 10) is disclosed and described. The forearm support 10 comprises a base 12, an adjustable upright 14, and a saddle 16. The upright 14 comprises two opposing ends, wherein the first end is coupled to the base 12 via an articulating hinge (or hinges) 13, wherein the second end supports the saddle 16. Upon deployment, the forearm support 10 vertically supports a gun forearm within the saddle 16 as supported by the upright 14 depending from the base 12.

Consistent with FIG. 1 through FIG. 5, the base 12 is a generally planar element having at least one hinge (13) that provides support and/or articulation to the upright 14 supported thereby. It is envisioned that the base 12 has a dimension sufficient to stand on a relatively flat surface without additional manipulation. It is envisioned that the base 12 includes weight or ballast to provide additional stability to the apparatus 10 overall. For example, in FIG. 3, the base 12 includes one or more weights 26 disposed within the base 12. The weight(s) 26 may be secured via a recess, collar, and/or mechanical means, such as fasteners (e.g., screws or wingnuts).

Figure 6:
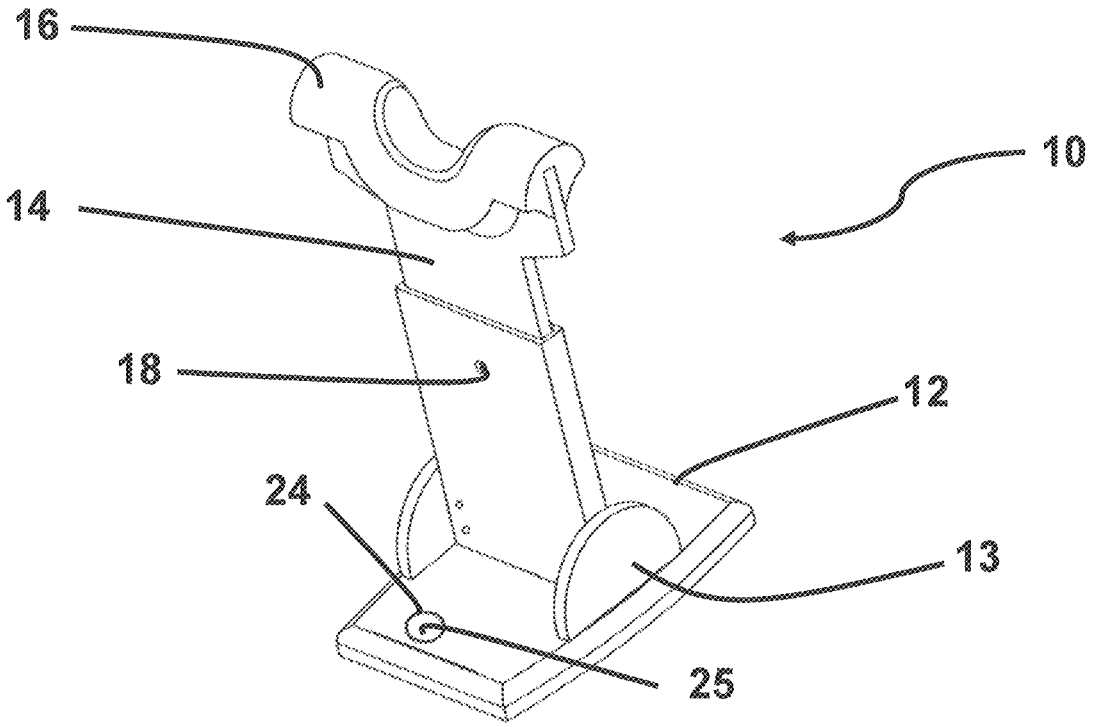
FIG. 6 is a perspective view of the saddle including a port for accessing an interior space of the base.

In another embodiment, consistent with FIG. 6, it is envisioned that the base 12 might include a port 24 for accessing a hollow interior, wherein the user could insert or remove material to provide ballast or weight to the base 12 as may be desired under certain circumstances. The port 24 may include a variety of configurations for providing ingress and egress to the interior of the base 12. The port 24 may comprises a void defining an opening into the base 12 and may include a cap, cover, or valve 25 that prevents the inserted material from inadvertent removal when the apparatus 10 is moved from one location to another. Upon displacement or removal of the cap, cover, and/or valve 25, the material may be selectively added to, removed, or otherwise emptied from the base 12 interior. The base 12 is in direct mechanical and physical communication with the upright 14.

The upright 14 may comprise a variety of configurations. The upright 14 is adjustable in multiple facets. For example, and consistent with the directional arrows illustrated in FIG. 2, the upright 14 is adjustable through 180 degrees of articulation in combination with the articulating hinge(s) 13 and as supported on the interior of base 12 and depending from the base 12 in a vertical orientation or disposition. One or more indexing mechanisms (generally denoted by 15) may be used to fix the upright 14 at an angle relative to the base. In particular, it is envisioned that the mechanism 15 may include a lock, an adjustable knob or nut, or other similar means that is released to provide the articulated movement of the upright 14 and then secured to fix the upright 14 in position. More particularly, it is envisioned that the upright 14 will preferably be fixed substantially vertical relative to the base, and approximately 90 degrees relative to the base 12.

Figure 4:
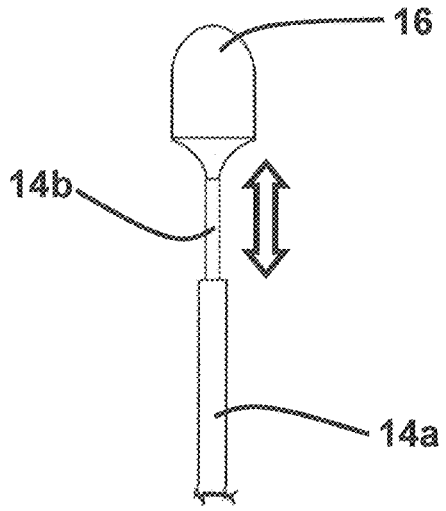
FIG. 4 is a side view of the adjustable upright and saddle.

Additionally, and consistent with FIG. 4, the upright 14 may also be vertically adjustable (as indicated by the vertically oriented bi-directional arrow) along its height. Vertical adjustment of the upright 14 permits adjustment to the relative vertical positioning of the saddle 16 and the seat 16*c* forming part of the saddle 16 that depend from the upright 14. Vertical adjustment of the upright 14 (and therefore the saddle 16 and its elements) provide versatility to the apparatus 10 by accommodating individuals of various sizes, skills, abilities and disabilities, and eccentricity(ies) of positioning and/or style to get optimal utilization from the apparatus 10.

Consistent with FIG. 4, and in one iteration, the upright 14 may comprise multiple segments that are telescopically arranged to provide the vertical positioning desired without need for removable mechanical elements for interference. In such an embodiment, the telescopically extendable segment or segments extending from the upright 14 may include a variety of means and mechanisms integral to the elements that allow for variable vertical positioning, including collars and/or stops that provide a vertical range for each segment (or segments).

In another version, also consistent with FIG. 4, the upright 14 comprises a first upright 14*a* and a second upright 14*b*, wherein the second upright 14*b* has a smaller dimension than the first upright 14*a* so that the second upright 14*b* may retract within and/or extend from the first upright 14*a*. In such a version, the second upright 14*b* is fixed into a specific vertical position or orientation by the alignment of indexing aperture(s) 18 aligned along the first upright 14*a* and second upright 14*b*. More particularly, and in one embodiment consistent with FIG. 1 and FIGS. 7*a* and 7*b*, a single indexing aperture 18*a* is formed on the first upright 14*a* and a plurality of indexing apertures 18*b* aligned as a single vertical column are formed on the second upright 14*b*. It is further envisioned that a plurality of indexing apertures 18*a* may be formed on the first upright 14*a* with a similar arrangement and scheme as may be found with the plurality of indexing apertures 18*b* formed on the second upright 14*b*, wherein each plurality of indexing apertures 18*a* and 18*b* are disposed in a single vertical column on each upright 14*a* and 14*b*, respectively.

A variety of means may be used to fix or impinge the aperture(s) 18, including one or more removal articles or tools 20 (e.g., sliding pin or bolt). It is envisioned that the impinging article or tool 20 may be removed and stowed when not being used. It is also envisioned that the impinging article 20 may include a tether 22 that inhibits loss or misplacement of the impinging article 20 when not being used. Alternatively, an outwardly biased spring button or other similarly constructed means may be used for fixing the uprights 14*a* and 14*b* into a stable position. In addition, it is envisioned that both an article or tool 20 and a combination of outwardly biased spring button or other similar means may be used in combination to secure the uprights 14*a* and 14*b* into a stable position.

Figure 5:
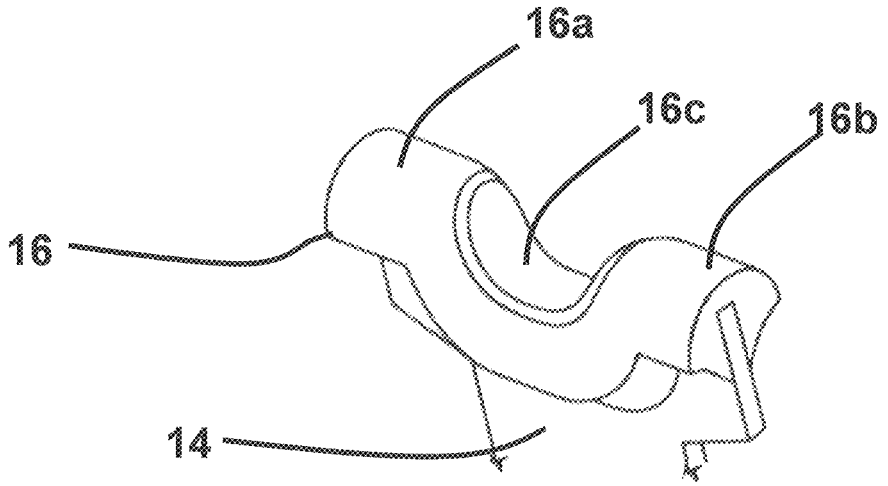
FIG. 5 is a perspective view of the saddle.

Consistent with FIG. 1 and FIG. 5, the saddle 16 depends from the terminus of the adjustable upright 14. The saddle 16 comprises a first pommel 16*a* and a second pommel 16*b* with a vertically recessed seat 16*c* disposed between the pommels 16*a*, 16*b*. As the immediate support for a gun forearm, the seat 16*c* receives and supports the gun forearm with the pommels 16*a*, 16*b* providing lateral bumpers to reduce the horizontal/lateral movement of the gun forearm during use with the forearm support apparatus 10. Consistent with the illustrations, and in particular, the saddle 16 (and elements 16*a*-16*c*) is disposed at the vertical terminus of second upright 14*b*, and with the saddle 16 temporarily fixed at a vertical height through mechanical manipulation and impingement of second upright 14*b* relative to the first upright 14*a*.

It is envisioned that the saddle 16 may comprise a variety of materials suitable for contact with and in physical support of a gun forearm, including but not limited to natural or faux-natural materials including leather, hide, pleather, or the like, and/or synthetic materials including returnably resilient material, foam, rubber, vinyl, and the like.

The utilization of the gun forearm support apparatus 10 allows a user to place the apparatus on a surface, whether it is the ground, an article placed on the ground, on an elevated surface, or other similar structures, with the forearm of the gun or firearm placed within the saddle 16. The base 12 provides stability to the apparatus 10, and assists in supporting the saddle 16 in its positioning via the upright(s) 14. The upright(s) 14 and saddle 16 height positioning may be adjustable between a minimum and maximum height, with the first upright 14*a* and its indexing aperture 18*a* aligned with the appropriately positioned indexing aperture 18*b* (as selected from the plurality of indexing apertures 18*b*) from the second upright 14*b* to set the desired height. The utilization of the apparatus 10 achieves a plurality of goals, including (i) enhanced firearm safety by providing the appropriately tailored height adjustment for the physical structure and ability of the user, (ii) improved firearm sighting, (iii) improved firearm accuracy and performance, and (iv) improved aesthetic appearance and general durability of the firearm(s) used with the apparatus 10.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. A gun forearm support apparatus comprising:

a base;

an adjustable upright depending from the base, wherein the upright is vertically adjustable and angularly adjustable, and wherein the upright is angularly adjustable through 180 degrees of articulation and positioned at an angle relative to base;

a locking mechanism for fixing the adjustable upright into various positions along 180 degrees of articulation; and, a saddle depending from the vertical terminus of the adjustable upright, the saddle comprising a first pommel and a second pommel with a vertically recessed seat disposed between the pommels, wherein the seat receives and supports the gun forearm and with the pommels providing lateral bumpers to reduce the lateral movement of the gun forearm.

2. The apparatus of claim 1, wherein the base comprises ballast.

3. The apparatus of claim 1, wherein the base comprises a removable weight.

4. The apparatus of claim 1, wherein the base comprises a port.

5. The apparatus of claim 4, wherein the port comprises a door.

6. The apparatus of claim 5, wherein the door is removable to access the hollow interior of the base.

7. The apparatus of claim 5, wherein the door is displaceable to access the hollow interior of the base.

8. The apparatus of claim 1, wherein the saddle comprises a vertically recessed seat adapted for receiving and supporting the gun forearm.

9. A gun forearm support apparatus comprising:

a base;

an adjustable upright assembly comprising a first upright depending from the base via articulation means and a second upright depending from the first upright, wherein the first upright comprises an interior space having larger dimensions than the second upright adapted to promote telescoping movement of the second upright relative to the first upright, wherein the first upright comprises at least one indexing aperture and the second upright comprising a plurality of indexing apertures disposed in a vertical column along a vertical axis coextensive to the at least one indexing aperture formed on the first upright;

the articulation means providing angular movement and positioning of the adjustable upright assembly, wherein the adjustable upright assembly is angularly adjustable through 180 degrees of articulation and positioned at an angle relative to base, wherein articulation means has a locking mechanism for fixing the adjustable upright into various positions along 180 degrees of articulation; and, a saddle depending from the vertical terminus of the adjustable upright, the saddle adapted to received and support the forearm of a gun.

10. The apparatus of claim 9, wherein the base comprises ballast.

11. The apparatus of claim 9, wherein the base comprises a removable weight.

12. The apparatus of claim 9, wherein the base comprises a port.

13. The apparatus of claim 12, wherein the port comprises a door.

14. The apparatus of claim 9, wherein the saddle comprises a vertically recessed seat.

15. The apparatus of claim 9, wherein the saddle comprises a returnably resilient material.

* * * * *